United States Patent [19]

Sorensen

[11] Patent Number: 4,478,166

[45] Date of Patent: Oct. 23, 1984

[54] BOAT

[76] Inventor: George C. Sorensen, 9812 17th Ave. SW., Seattle, Wash. 98106

[21] Appl. No.: 219,338

[22] Filed: Dec. 22, 1980

[51] Int. Cl.[3] ..... B63B 1/20

[52] U.S. Cl. ..... 114/290; 114/56; 114/61

[58] Field of Search ..... D12/312; 114/271, 283, 114/288, 289, 290, 292, 56, 61, 355–358; 9/6 R, 6 P

[56] References Cited

U.S. PATENT DOCUMENTS

| | | | |
|---|---|---|---|
| D. 226,870 | 5/1973 | Livingston | D12/312 |
| 3,148,652 | 9/1964 | Canazzi | 114/290 |
| 3,600,733 | 8/1971 | Lippisch | 114/288 |
| 3,937,164 | 2/1976 | Austin | 114/288 |
| 4,091,761 | 5/1978 | Fehn | 114/290 |

*Primary Examiner*—Sherman D. Basinger

*Attorney, Agent, or Firm*—Seed and Berry

[57] ABSTRACT

A boat which greatly reduces ventilation under a boat and cavitation in an outboard motor's propeller is disclosed. Preferably, a skeg and hulls are arranged to produce a zone behind the boat which is substantially free of froth and in which a propeller may operate efficiently. Preferably, the skeg is trapezoidal in cross-section with substantially planar surfaces. It runs forward from its broad end to its source, which preferably lies in a section about 60–75% of the boat's length forward from the stern. Channels running between the skeg and hulls uniformly decrease in area as they run aftward. Thus, lift of the stern is increased by the increase in the apparent water pressure and velocity in the channels. The skeg's shape acts as a shield for the propeller and helps to direct the water outwardly to develop a zone behind the skeg where the motor can operate more efficiently.

2 Claims, 7 Drawing Figures

BOAT

DESCRIPTION

1. Technical Field

This invention relates to a boat which significantly reduces ventilation and propeller cavitation and has improved lift at the stern. More particularly, this invention relates to use of a skeg and channels along the hull's bottom to improve the boat's performance.

2. Background Art

Cavitation has hindered power boating for a long time. The froth of air and water whcih often develops behind a boat makes the propellers perform inefficiently. Power is lost. Both the lift and thrust of the boat are adversely affected. Many attempts have been made to reduce cavitation or to combat it through designs to increase lift or thrust. Solving the cavitation problem and improving lift at the stern allows use of larger and more powerful motors on boats because the added lift would more than compensate for the added weight.

An object of this invention is to reduce substantially cavitation and thereby improve propeller performance. Design Patent 226,870 (Livingston) discloses a twin-hulled boat having a central skeg forming a pair of channels between the hulls. However, although appearing similar at first blush to the boat of the present invention, that design fails to achieve the perfomance of this invention because the flow of water relative to the walls of the skeg creates undue turbulence at the propeller, and the fluid in the channels between the skeg and the twin hulls is not acting to increase the lift in the aft portion of the channels.

DESCRIPTION OF INVENTION

A preferred boat according to the present invention is designed to hold an outboard motor. It has a central transom at the stern under which a skeg is centrally aligned. Two hulls extend along each side of the skeg so as to define the outer walls of two inverted channels whose inner walls are the skeg and whose ceiling is the central portion of the bottom of the boat extending between the two hulls. The skeg is preferably trapezoidal in cross-section with flat sides and bottom. It extends forward with a uniformly decreasing area over a major portion of the boat. Preferably, it extends over about 60–75% of the boat's length. The bottom planar surface of the skeg forms an additional planing surface. The change in area of the skeg is preferably such that the area of each channel decreases by about 20% of the inlet reference area for each foot moved aftward. As a result, the fluid in the channels is pressurized as the boat is propelled, and improved lift results. At its aft end, the skeg preferably extends to a depth corresponding to the approximate location of the cavitation plate of an outboard motor. The skeg's area preferably is large enough to produce a zone behind the boat to be occupied by the depending portion of the motor adjoining the cavitation plate. Cavitation is greatly reduced or substantially eliminated, and lift for the stern is increased within the channels and beneath the skeg.

BEST MODE FOR CARRYING OUT THE INVENTION

Figure 1:
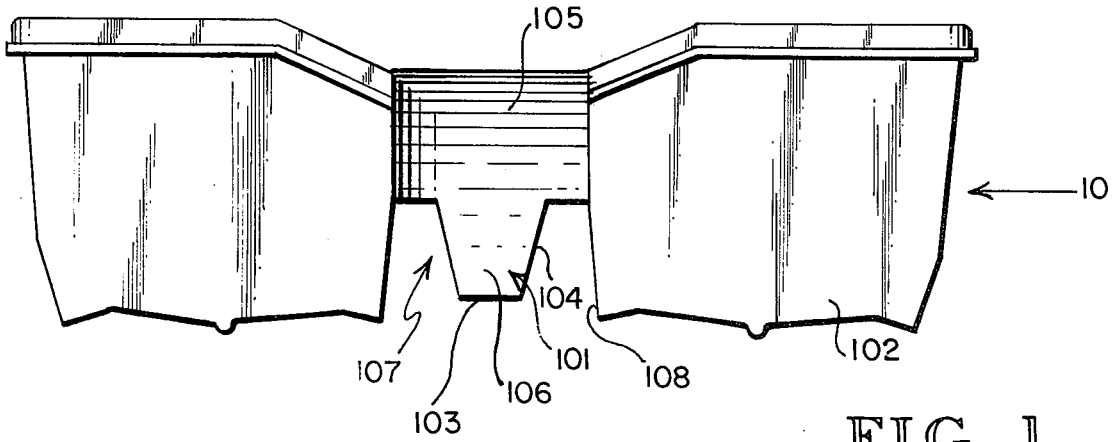
FIG. 1 shows a view of the stern of a preferred boat which incorporates the features of this invention.

To simplify the discussion, focus will be placed on a preferred boat for a single outboard motor, as shown in the drawings. Although only a single skeg with two channels is shown, a boat incorporating the features of this invention may use multiple skegs and channels for more than one motor. Ordinarily, one motor will be used for each skeg. The function of multiple skegs and channels will be the same as that in the preferred boat shown. Those skilled in the art should readily be able to convert this limited description to larger boats and for those having an inboard-outboard drive rather than an outboard engine.

A powered boat actually moves over relatively quiet water by thrust generated in a propeller pushing against the water. Often it is easier to think that the water moves under the boat. Throughout this discussion, the equivalent model of a static boat with flowing water will be used. Thus, the apparent velocity of water in the channels will be discussed.

As seen from the stern in FIG. 1, a preferred boat 10 comprises a skeg 101 aligned centrally beneath a transom 105 and two outer hulls 102 arranged on the sides of the skeg 101. The skeg 101 and hulls 102 are connected along the bottom of the transom 105. Thus two channels 107 are defined, one on each side of the skeg 101. Because the skeg 101 preferably runs forward over only a portion of the boat's length, the bow (shown in FIG. 2) may appear to have only one channel between two outer hulls 102. Preferably, the skeg 101 runs over about 60–75% of the boat's overall length. More preferably, the skeg 101 extends over at least 60% of the overall length.

Figure 2:
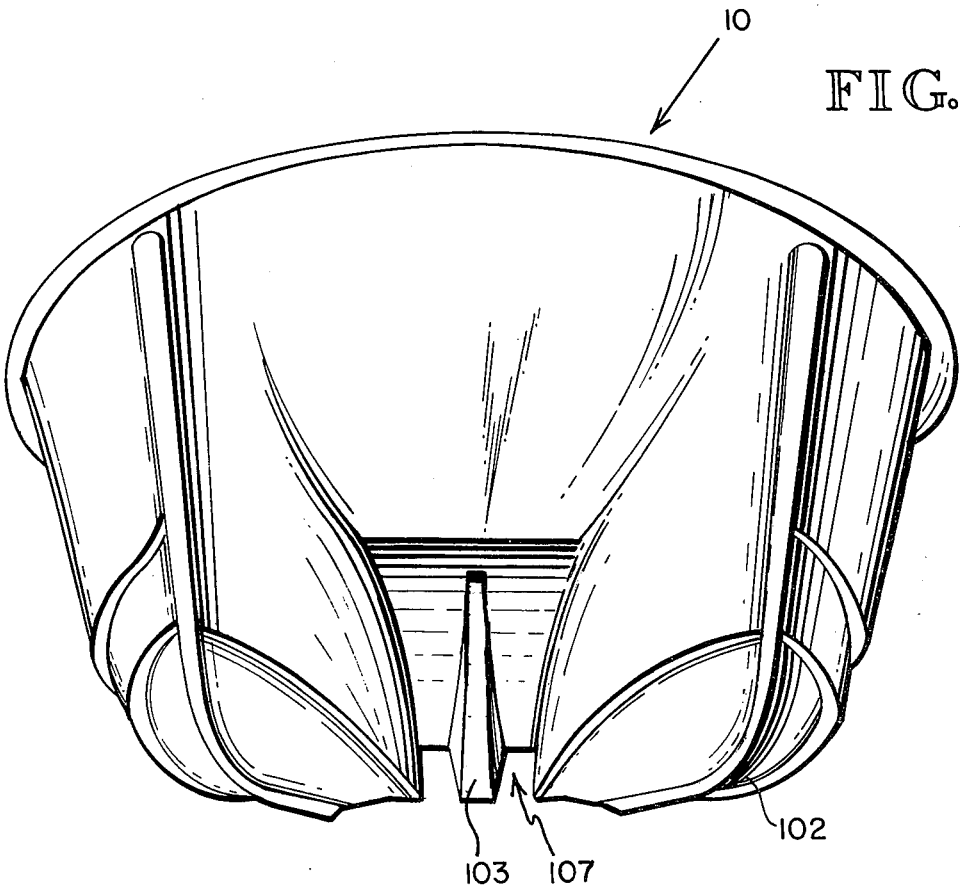
FIG. 2 shows a view of the bow of a preferred boat.
Figure 4A:
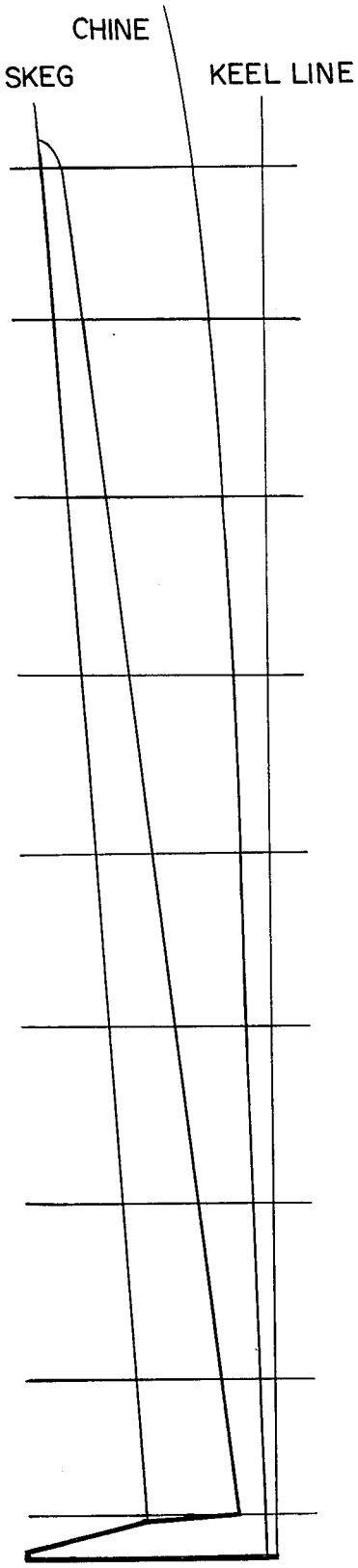
FIG. 4A shows a cross-section of a preferred boat, taken along line 4—4 of FIG. 3, showing a preferred skeg.

As seen in FIGS. 1 and 2, the skeg 101 and hulls 102 extend downwardly from the transom line to establish the channels 107. The hulls 102 extend downwardly to a depth below or at least to the depth reached by the skeg's aft end 106. FIG. 4A shows a hull 102 more clearly in relation to the skeg. Preferably, the hulls 102 form a substantially planar surface for the boat. Keels may be raised on the hulls, although the two hull construction provides a good measure of directional stability even without keels. In the illustrated embodiment, the bow is shown as forwardly curved, but may be blunt or have some other shape without departing from the present invention.

Figure 3:
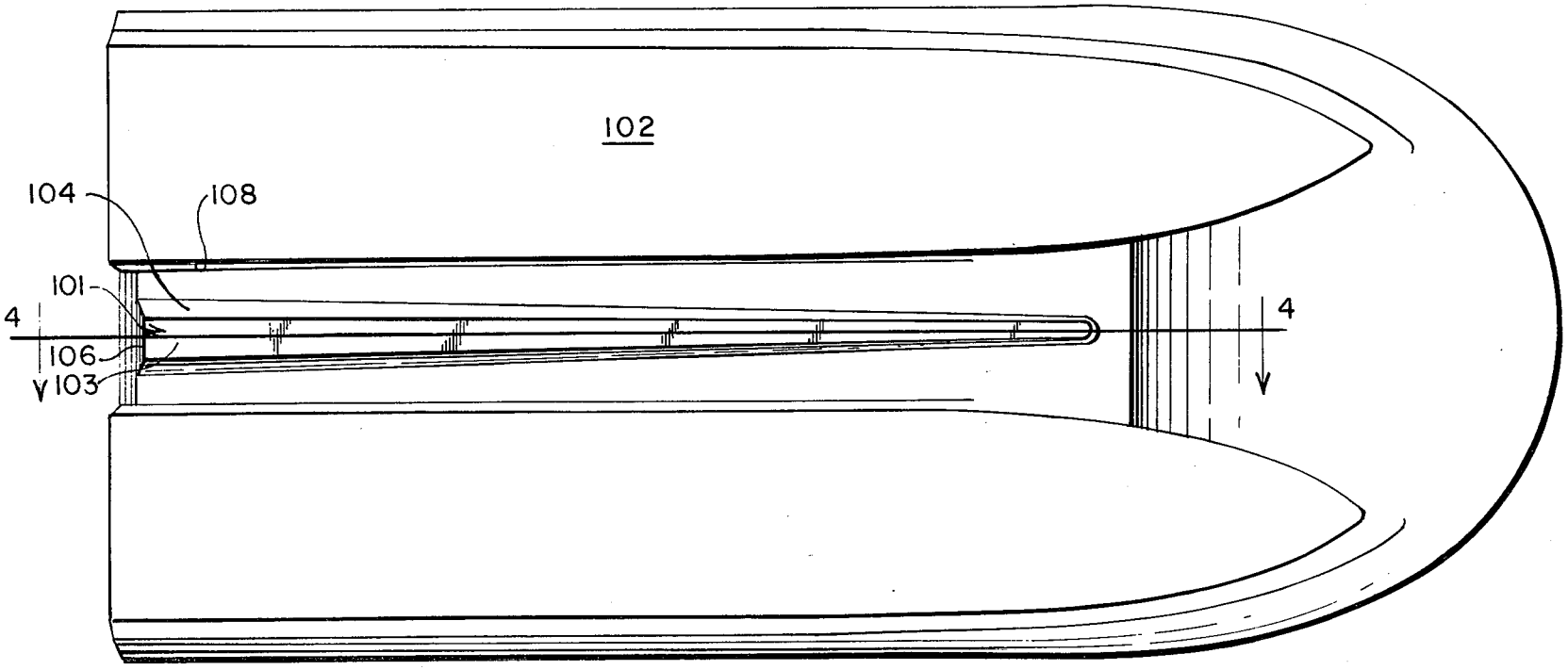
FIG. 3 shows a view of the bottom of a preferred boat, showing the skeg and channel arrangement which is preferred.

FIG. 3 shows a preferred boat 10 in greater detail. Its hulls 102 are arranged substantially parallel to the skeg 101. The skeg 101 has substantially smooth longitudinal surfaces 104 at the sides which taper outwardly and downwardly as the skeg extends aftward. If planar, as preferred, the skeg's bottom 103 functions as an additional planing surface for the boat. The aft end 106 of the skeg 101 extends downwardly from the bottom of the transom preferably to a level no lower than the bottom of the hulls 102 and to a depth corresponding approximately to that occupied by the cavitation plate of an outboard motor supported from the transom. This will normally locate the propeller in proper position below the planing surfaces of the boat. Preferably, the skeg 101 is trapezoidal in cross-section so that its width will produce a desired flow pattern behind the boat and to provide good relief for the mold if the boat if of fiberglass construction, as preferred. The inside surfaces 108 of the hulls 102 opposing the skeg 101 are preferably planar throughout most of their length and may be sloped as needed for release from the mold. At its aft end 106, the preferred skeg is wide enough so that a zone in the wake of the boat wider than the depending motor housing is substantially undisturbed.

Figure 4B:
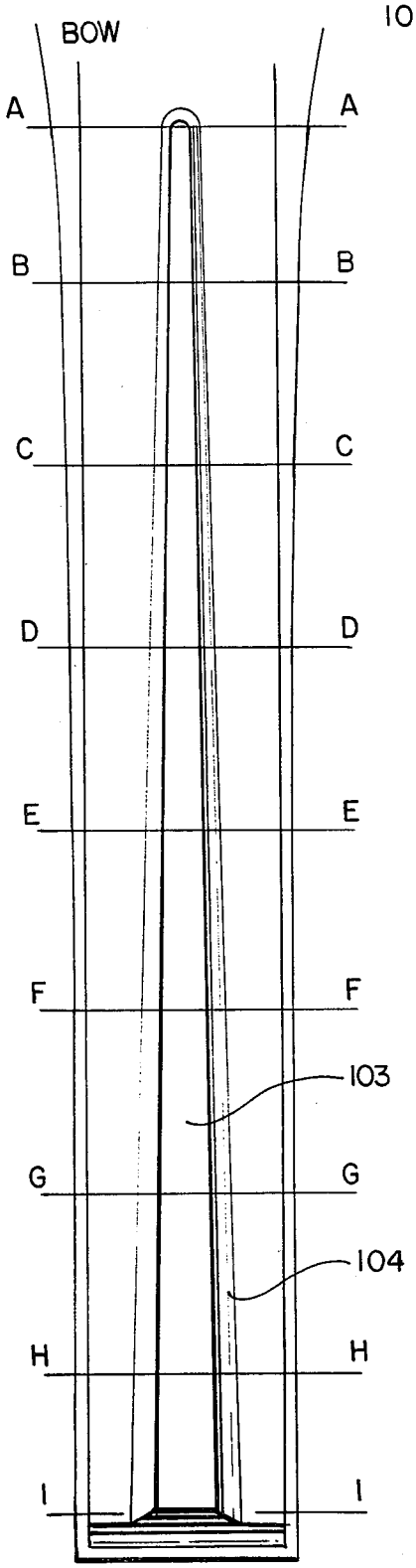
FIG. 4B shows a detail of a preferred skeg as in FIG. 3, showing the sections for FIG. 4C.
Figure 4C:
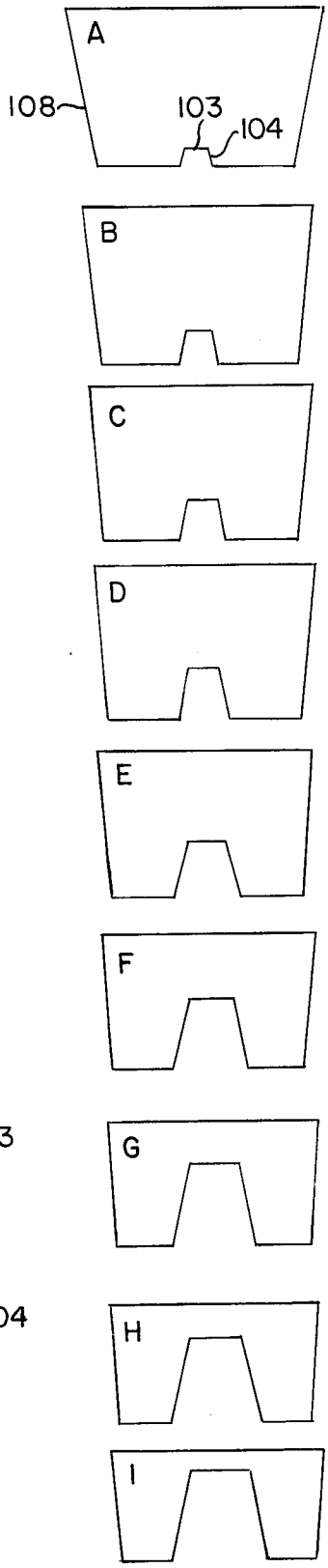
FIG. 4C shows the change in cross-sectional area of the channels as the skeg runs aftward in a preferred boat.
Figure 5:
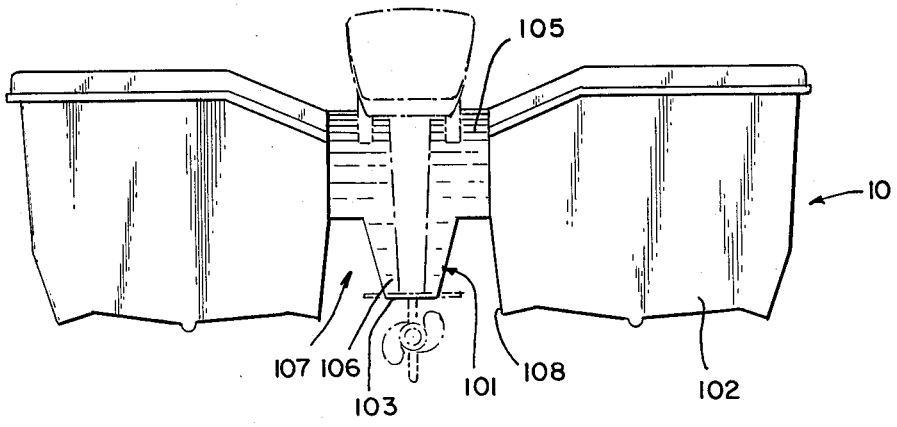
FIG. 5 shows a view of the stern, similar to FIG. 1, having an outboard motor on the transom.

The channels 107 between the skeg 101 and hulls 102 direct the water in gradually diverging paths of decreasing cross-section because of the laterally growing skeg. The channels also increase lift in the stern, because the water's apparent pressure and velocity increase as the channel's cross-section decreases in the aft direction. FIGS. 4B and 4C detail the area changes for a preferred skeg and channel arrangement. In FIG. 4C, the illustrated sections are taken with the boat upside down. The upper line for each section is a line which connects together the bottom of the inner hull walls 108 that form the channels 107. The remaining lines of the section figures represent the boat's bottom structure between the hulls 102 (i.e., the skeg, upper walls of the channels, and inner sidewalls of the hulls). The area of the channels at point B preferably is about 80% of the area at point A. Because the inner sidewalls of the hulls opposite the skeg are substantially planar and parallel to the skeg, the cross-sectional area decrease is substantially caused by the growth of the skeg. A similar uniform decrease will occur throughout the travel aftward. That is, the area of each channel preferably decreases by about 20% from the area at its reference inlet for each foot of travel aftward.

The dimensions of the skeg 101 at its aft end 106 are important. This end is preferably wide enough and deep enough to provide an area behind the boat which is relatively free of turbulence for the depending portion of the motor housing (the power leg) above the cavitation plate. The end assists in markedly reducing or eliminating cavitation at the propeller so that it performs more efficiently. A trapezoidal cross-section for the skeg is preferred because it allows for the area decrease in each channel 107 while providing suitable zone behind the boat 10. The bottom base of this trapezoid is ordinarily at least about 3.5 to 4.0 inches in width so as to be wider than the power leg of the normal outboard motor.

The gradual growth of the skeg's width produces a proper flow behind the boat. Preferably, the skeg 101 has smooth planar surfaces to aid in establishing the proper flow pattern for the water exiting at the stern. The planar bottom 103 functions as a planing surface and increases lift at the stern. It also helps to bring the boat into a proper planing angle. In this regard, the gradual reduction in the area of the channels 107 along the planar sides 104 of the skeg 101 results in pressurizing of the fluid in the channels, thereby providing significant lift in the area between the hulls 102 as well as therebeneath.

The preferred boat 10 has a blunter V-shaped entry to the channels 107 than previous boats of the same general type (such as the Livingston boat shown in Design Patent 226,870) to give a steeply angled bow, reducing the amount of air which can enter the channels. Because less air is entrained, the water exiting from the channels produces less cavitation in the propeller. The air which mixes at the propeller comes either from exhaust of the engine or from entrainment with the propeller swirl. This air, however, is necessary for proper and efficient operation of the outboard motor. This design helps to eliminate undesirable surplus air passing beneath the boat.

Although a preferred embodiment of this invention has been illustrated and described, variations will be apparent to those skilled in the art. This invention should not be limited to these specific embodiments, unless the prior art or the scope and nature of the appended claims make it necessary.

I claim:

1. A boat capable of supporting an outboard motor having a propeller and a cavitation plate comprising at least one transom to support the motor, a skeg aligned under the center of the transom and extending forward over at least a portion of the boat's length, and hulls arranged substantially parallel to the skeg, extending downwardly from the transom's bottom and defining with the skeg and transom two channels along the boat's bottom wherein:

(a) the skeg is symmetrical about the longitudinal centerline of the boat and has a substantially trapezoidal cross-section having only three, substantially planar, wetted surfaces, the surfaces forming a base and two sides of the skeg, each surface being substantially a single plane lacking discontinuities, wherein the area of the trapezoidal skeg uniformly increases as the skeg runs aftward so that at its aft end, the skeg sustantially shields the propeller to reduce cavitation, the aft end of the skeg extends downwardly from the bottom of the transom to a depth corresponding approximately to that of the cavitation plate of the motor supported from the transom, and the base of the skeg defines as additional planing surface for the boat; and (b) the channels substantially uniformly decrease in cross-sectional area to increase the apparent water pressure and velocity in each channel, resulting in an increase in lift of the boat's stern and a further reduction in cavitation of the propeller, wherein the area of each channel uniformly decreases by about 20% from the area at its reference inlet for each foot of travel aftward, and wherein the hulls extend downwardly at least as far as the depth reached by the aft end of the skeg.

2. The boat of claim 1 wherein the bottom base of the trapezoidal skeg is about 3.5 to 4.0 inches at the aft end of the skeg.

* * * * *